US008322063B1

(12) United States Patent
Battaglia

(10) Patent No.: US 8,322,063 B1
(45) Date of Patent: Dec. 4, 2012

(54) FIREARMS MAGAZINE FOR RIFLE LENGTH CARTRIDGES

(76) Inventor: Vincent P. Battaglia, Easton, CT (US)

( * ) Notice: Subject to any disclaimer, the term of this patent is extended or adjusted under 35 U.S.C. 154(b) by 0 days.

(21) Appl. No.: 13/232,194

(22) Filed: Sep. 14, 2011

Related U.S. Application Data

(63) Continuation of application No. 12/638,520, filed on Dec. 15, 2009, now Pat. No. 8,028,455.

(51) Int. Cl.
*F41A 9/71* (2006.01)

(52) U.S. Cl. ..... 42/49.02

(58) Field of Classification Search ..... 42/49.02, 42/49.01, 50, 18, 22, 6; 89/34, 33.1, 197, 89/33.01
See application file for complete search history.

(56) References Cited

U.S. PATENT DOCUMENTS

| | | | | | |
|---|---|---|---|---|---|
| 2,659,173 | A | * | 11/1953 | Capito | 42/87 |
| 2,895,248 | A | * | 7/1959 | Sawin | 42/50 |
| 4,876,813 | A | | 10/1989 | Tuma | |
| 5,285,590 | A | * | 2/1994 | Howard | 42/50 |
| 5,329,718 | A | | 7/1994 | Howard | |
| 5,615,505 | A | | 4/1997 | Vaid | |
| 5,638,626 | A | | 6/1997 | Westrom | |
| 5,664,355 | A | | 9/1997 | Ronkainen | |
| 5,704,148 | A | * | 1/1998 | Valorose | 42/50 |
| 5,755,052 | A | | 5/1998 | Keeney | |
| 5,761,841 | A | | 6/1998 | Snick | |
| 5,956,878 | A | | 9/1999 | Yang | |
| 7,093,386 | B1 | | 8/2006 | Vieweg | |
| 7,318,294 | B2 | | 1/2008 | Zimmermann | |
| 7,444,775 | B1 | * | 11/2008 | Schuetz | 42/76.01 |
| 7,533,483 | B1 | | 5/2009 | Alzamora et al. | |
| 2010/0307042 | A1 | | 12/2010 | Jarboe et al. | |

OTHER PUBLICATIONS

U.S. Appl. No. 61/184,630 of Jarboe et al.; filed Jun. 5, 2009.

* cited by examiner

*Primary Examiner* — Michael Carone
*Assistant Examiner* — Reginald Tillman, Jr.
(74) *Attorney, Agent, or Firm* — DeLio & Peterson, LLC; Peter W. Peterson

(57) ABSTRACT

A firearms magazine has compound tapered side walls and feed lips having substantially parallel end portions for maintaining contact with the cartridge as it is loaded. Removable inserts reduce the interior length and width to hold cartridges of different sizes. One insert has a channel along its height to protect the cartridge noses, and is held by a reinforcing member. A movable cartridge follower feeds the cartridges out of the magazine and has a pair of projections extending along its length for contacting and centering the last cartridge and a projection at one end slideable in the channel of the insert. The follower has one or more downwardly extending members to contact the floor or walls to maintain position of the follower with respect thereto. Projections extending inward from the side walls contact shoulders of the firearms cartridges in sliding relationship as they are fed out of the magazine.

6 Claims, 7 Drawing Sheets

FIREARMS MAGAZINE FOR RIFLE LENGTH CARTRIDGES

BACKGROUND OF THE INVENTION

1. Field of the Invention

This invention relates to a magazine for feeding cartridges into the chamber of a firearm, and more specifically relates to a firearms magazine for rifle length cartridges and its constitution of specific attributes that enhance more accurate feeding and projectile tip protection.

2. Description of Related Art

Firearms Magazines have been developed for their intended caliber and cartridge length to be held in a specific arrangement and presented to the firearm chamber through various firearm receiver actions. In general the prior art has used basic design guidelines for firearm magazines without specific regards and attributes for determined needs of the operator or shooter. The prior art has not effectively protected the tip of the cartridge projectile from dents or flattening of the apex of the tip, resulting in erratic bullet flight and decreased accuracy. Also, the prior art has not consistently provided exact centerline presentation of the cartridge case to the firearm chamber which enhances the seating or final positioning of the cartridge case shoulder in concentricity to the chamber. Further prior art magazines generally are sized to receive a specific length of the SAAMI (Sporting Arms and Ammunition Manufacturers' Institute) designated length with no modularity or adaptability to change projectile length inside the same cartridge case and simultaneously protect the apex of the bullet tip.

SUMMARY OF THE INVENTION

Bearing in mind the problems and deficiencies of the prior art, it is therefore an object of the present invention to provide an improved firearm cartridge magazine that has one or more of the following advantages: 1) effective guiding to the cartridges; 2) protection to the noses of the cartridges; 3) increased magazine strength; 4) increased efficiency in feeding of cartridges into breech; 5) better centerline presentation of the cartridge case to the firearm chamber to enhance the final positioning of the cartridge case shoulder in concentricity to the chamber; and 6) modular configuration to permit cartridges of different sizes to be employed.

Still other objects and advantages of the invention will in part be obvious and will in part be apparent from the specification.

The above and other objects, which will be apparent to those skilled in the art, are achieved in the present invention which is directed to a firearms magazine for retaining and feeding firearms cartridges. In one aspect the magazine comprises a housing having a base capable of vertically stacking a plurality of firearms cartridges, opposite side walls above the base, at least a portion of which are non-parallel and taper in the direction of longitudinal axes of the cartridges from a greater internal width to a lesser internal width. The non-parallel tapered opposite side wall portions are capable of retaining and feeding the firearms cartridges. The magazine also includes feed lips at an open end of and extending from the non-parallel tapered opposite side wall portions for engaging a firearms cartridge as it is loaded from the magazine into a gun. The feed lips have substantially parallel end portions for maintaining contact with at least a portion of the length of the cartridge as it is loaded.

The non-parallel opposite side wall portions may extend along a length less than the length of the firearms cartridges.

The non-parallel opposite side wall portions may further taper in the direction of stacking of the cartridges from a greater internal width adjacent the base to a lesser internal width adjacent the feed lips.

In another aspect, the firearms magazine comprises opposite side walls defining an interior length sufficient to retain a plurality of firearms cartridges of a first length, and a removable insert between the opposite side walls reducing the interior length to retain a plurality of firearms cartridges of a second length less than the first length. The removable insert may have a channel along its height to receive the noses of the firearms cartridges of the second length and permit the firearms cartridges of the second length to feed out of the magazine. The slot of the removable insert may be tapered in cross-section.

In a further aspect, the firearms magazine comprises opposite side walls defining an interior width sufficient to retain a plurality of firearms cartridges of a first diameter, and a removable insert between the opposite side walls reducing the interior width to retain a plurality of firearms cartridges of a second diameter less than the first diameter.

In yet another aspect, the firearms magazine comprises opposite side walls defining an interior sufficient to retain a plurality of firearms cartridges, a reinforcing member extending between and along an end of the opposite side walls corresponding to noses of the firearms cartridges, a detent between the reinforcing member and the opposite side walls for locating position of the reinforcing member with respect to the opposite side walls, and an insert within the reinforcing member for guiding noses of the firearms cartridges. The reinforcing member may be welded to the opposite side walls of the magazine. The detent may comprise a projection to aid in the manufacturing and assembly process in one of the reinforcing member and opposite side walls, and a recess in the other of the reinforcing member and opposite side walls.

In a further aspect, the firearms magazine comprises opposite side walls defining an interior sufficient to retain a plurality of firearms cartridges, a reinforcing member extending between and along an end of the opposite side walls corresponding to noses of the firearms cartridges, an insert within the reinforcing member for guiding noses of the firearms cartridges, and a projection on the insert or the reinforcing member for locating position of the insert with respect to the reinforcing member. The projection may be on one of the insert or reinforcing member and the other of the insert or reinforcing member may have a slot, and the projection may contact an end of the slot to locate position of the insert with respect to the reinforcing member. The projection may comprise a spring on the reinforcing member and the insert may include a recess, and the spring may contact the recess to locate position of the insert with respect to the reinforcing member.

In another aspect, the firearms magazine comprises opposite side walls and a floor defining an interior sufficient to retain a plurality of firearms cartridges, a movable cartridge follower between the opposite side walls for feeding the firearms cartridges out of the magazine and into a gun, a spring between the follower and the floor for urging the follower away from the floor, and a detent between the spring and the floor for locating an end of the spring at a desired location with respect to the floor.

In yet a further aspect, the firearms magazine comprises opposite side walls defining an interior sufficient to retain a plurality of firearms cartridges, a cartridge follower movable between the opposite side walls for feeding the firearms cartridges out of the magazine and into a gun, and a pair of projections extending along at least a portion of a length the cartridge follower for contacting a last firearms cartridge and centering the cartridge between the opposite side walls as it is fed out of the magazine.

In yet another aspect, the firearms magazine comprises opposite side walls defining an interior sufficient to retain a plurality of firearms cartridges, a movable cartridge follower between the opposite side walls for feeding the firearms cartridges out of the magazine and into a gun, and projections extending along at least a portion of a height of the cartridge follower and slideable along the interior of the opposite side walls for preventing tilting of the follower as the cartridges are fed out of the magazine.

In a further aspect, the firearms magazine comprises opposite side walls defining an interior sufficient to retain a plurality of firearms cartridges, a floor and rear wall between the opposite side walls, a movable cartridge follower between the opposite side walls for feeding the firearms cartridges out of the magazine and into a gun, and at least one member extending downward below the follower to contact the floor or walls to maintain position of the follower with respect thereto. The downwardly extending member may contact the floor to maintain the follower at a desired height above the floor. Alternatively or additionally, the downwardly extending member may contact the walls to maintain angle of the follower with respect thereto.

In another aspect, the firearms magazine comprises opposite side walls defining an interior sufficient to retain and feed a plurality of firearms cartridges, an insert between the opposite side walls having a slot along its height to receive noses of the firearms cartridges in sliding relationship as the firearms cartridges are fed out of the magazine, and a movable cartridge follower between the opposite side walls for urging the firearms cartridges out of the magazine and into a gun, the follower having a projection at one end slideable in the slot of the insert as the follower urges the firearms cartridges out of the magazine. The slot insert may taper from a wider width at a lower end of the firearms magazine to a narrower width at the opposite, upper end of the firearms magazine.

In yet a further aspect, the firearms magazine comprises opposite side walls defining an interior sufficient to retain and feed a plurality of firearms cartridges, and a projection extending inward from each of the opposite side walls and extending along a height of the walls, the projections contacting the shoulders of the firearms cartridges in sliding relationship as the firearms cartridges are fed out of the magazine.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S) OF THE INVENTION

In describing embodiments of the present invention, reference will be made herein to FIGS. 1-15 of the drawings in which like numerals refer to like features of the invention.

Figure 1:
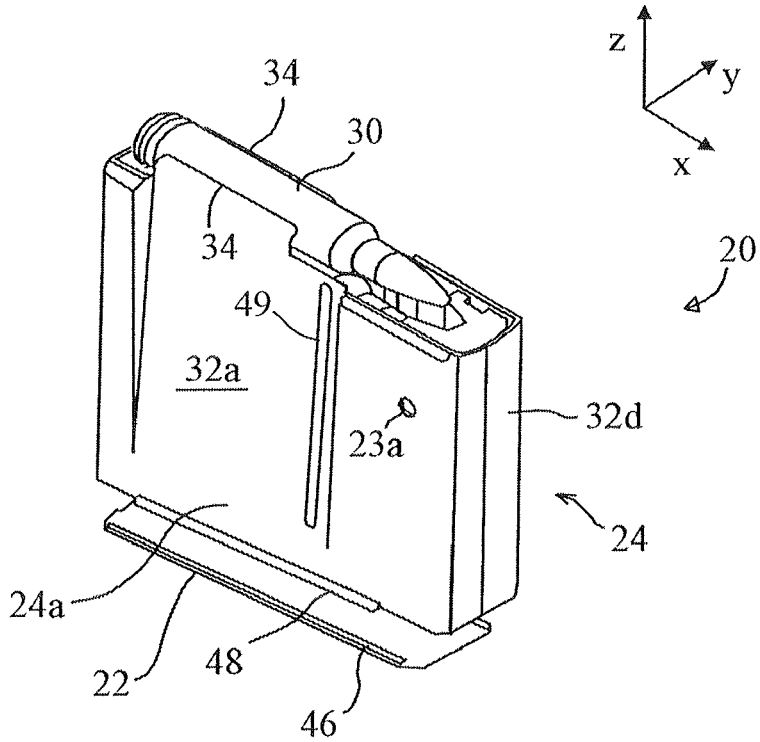
FIG. 1 is a perspective view of an embodiment of the cartridge magazine of the present invention with the floor plate removed for loading.
Figure 2:
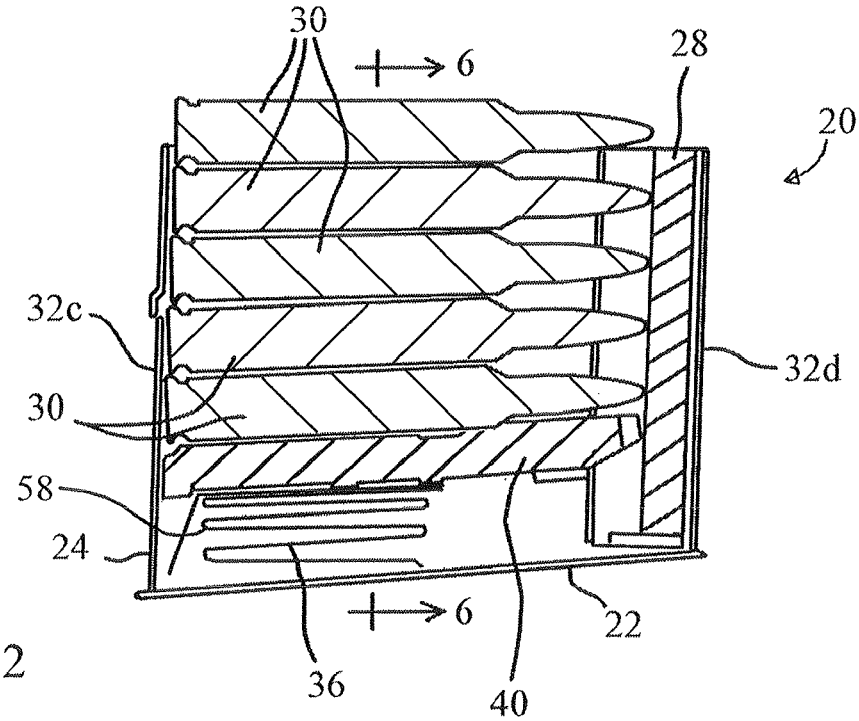
FIG. 2 is a side cross-sectional elevational view of the magazine of FIG. 1, with the floor plate in place.

The magazine of the present invention may be used for rifle length cartridges, but may also be employed with any type of cartridge for automatic or semi-automatic firearms. Magazine 20 comprises housing 24 having generally planar opposing side walls 24*a*, 24*b* and rear wall 32*c* and front wall 32*d* joining the side walls. Housing 24 may be made of any suitable material metal or polymer, with an example of the former being carbonitrided case hardened 1010 steel of about 0.040 in (1 mm) thickness. Housing 24 is may be integrally formed from sheet metal and folded as shown so that the sheet ends contact each other at a seam extending upward midway along the front wall 32*d*. A floor plate 22 encloses the lower end of housing 24 to define, along with the side walls and front and back walls, an interior space sufficient to retain any desired number of cartridges having longitudinal axes extending generally horizontally (in the x-direction as shown in FIG. 1) and stacked generally vertically (in the z-direction as shown in FIG. 1). The distance between the housing front and rear walls may correspond generally to and be slightly greater than the length of the rifle or other firearm cartridges 30 to be stored. A pair of feed lips 34 are positioned on the upper edges of the side walls to single feed the cartridges into the gun, rifle or other firearm.

The spacing between the side walls is larger than the cartridge diameter at the lower ends and may smoothly taper down to a spacing corresponding to the cartridge diameter to provide a sliding fit between the walls as the cartridges exit the top of the housing. This enables the cartridges to be staggered from side-to-side (in the y-direction as shown in FIG. 1) at the lower end of the housing. Side wall portions 32*a*, 32*b* can be of any suitable configuration to hold the cartridges, and may be provided with a compound taper as shown in the drawings. The distance between the side walls contacting the cartridges depends on the configuration of the cartridge stacking arrangement. In the embodiment shown in FIG. 6, where the cartridges are stacked generally vertically, the side walls taper inward from a wider spacing near the lower end, greater than the diameter or caliber of the cartridges 30 (but less than twice the diameter), to a narrower spacing at the upper end corresponding generally to the diameter or caliber of the cartridges 30. For less feeding friction, the cartridge stacking arrangement may be such that there are no more than five points of contact among each group of three adjacent cartridges, i.e., three points of contact where each of the three cartridge contacts the side wall plus two points of contact where the three cartridges contact each other.

Figure 3:
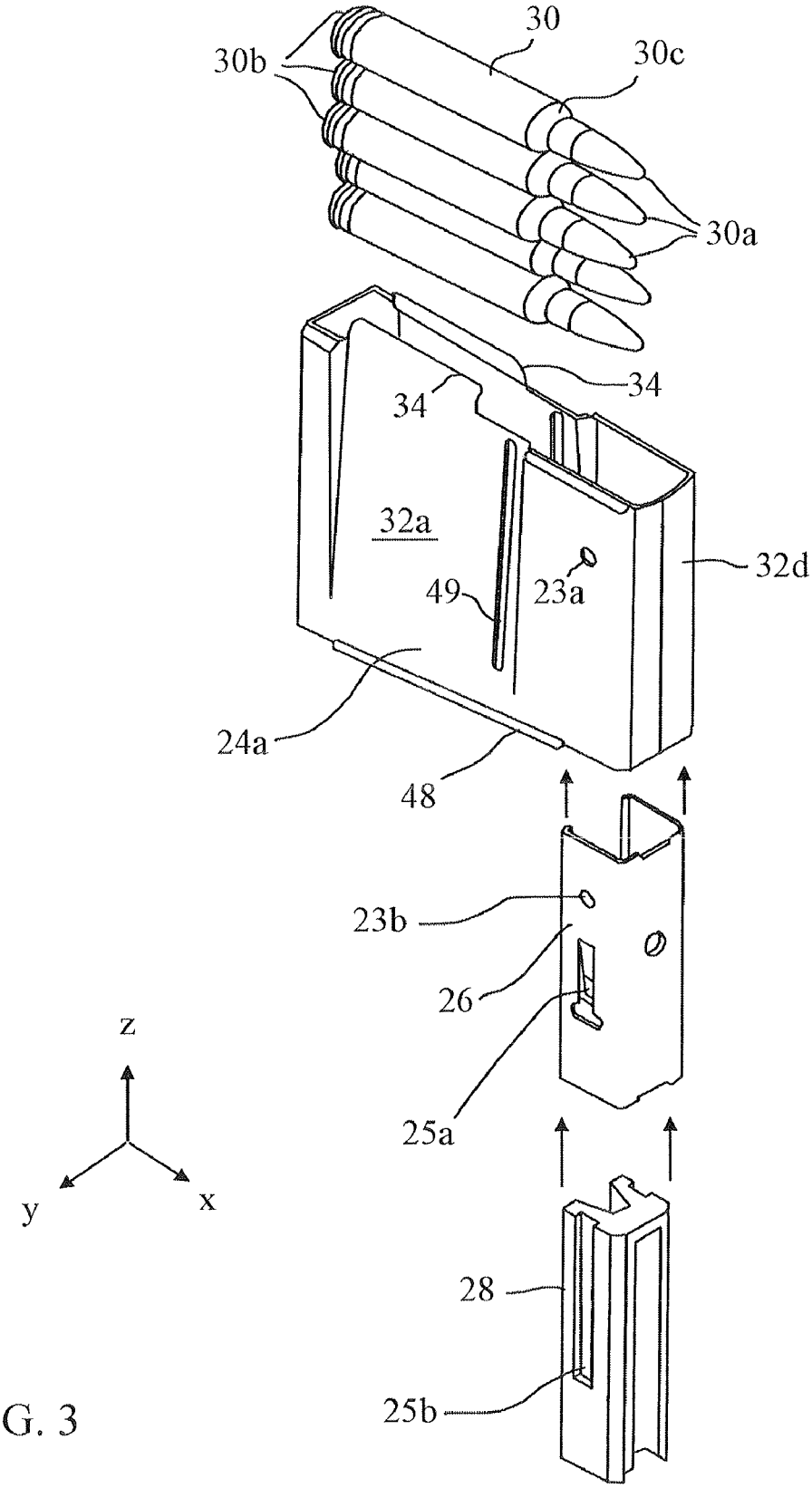
FIG. 3 is an exploded view of the magazine housing of FIG. 1 showing the cartridges, reinforcing member and replaceable guide insert.

In addition to tapering from a greater internal width to a lesser internal width from bottom to top (the z-direction as shown in FIG. 1), the portions 32*a*, 32*b* of the side walls 24*a*, 24*b*, respectively also taper inward from the rear side to the front side of the housing (the x-direction as shown in FIG. 1), corresponding to the base 30*b* and nose or tip 30*a* ends of the cartridges 30, respectively (FIG. 3). Tapering portions 32*a*, 32*b* as shown are non-parallel in two dimensions (x and z) and may extend along only the mid-portion of the length of the cartridge 30 as shown to retain and feed the cartridges. Because the cartridges 30 themselves are typically slightly tapered from the base to the nose (e.g., on the order of 1°), the angle of taper of portions 32*a*, 32*b* in the x-direction may correspond to the taper of the cartridge being housed. Ribs 49 are formed in and extend vertically (z-direction) along side walls 24*a*, 24*b*. Ribs 49 may be angled (as seen in top plan view in FIG. 8) to correspond to the angle of the shoulder 30*c* (FIG. 3) of the cartridges 30, and help position the cartridges as they are fed out of the magazine since the shoulders contact and slide upward along the ribs.

Figure 6:
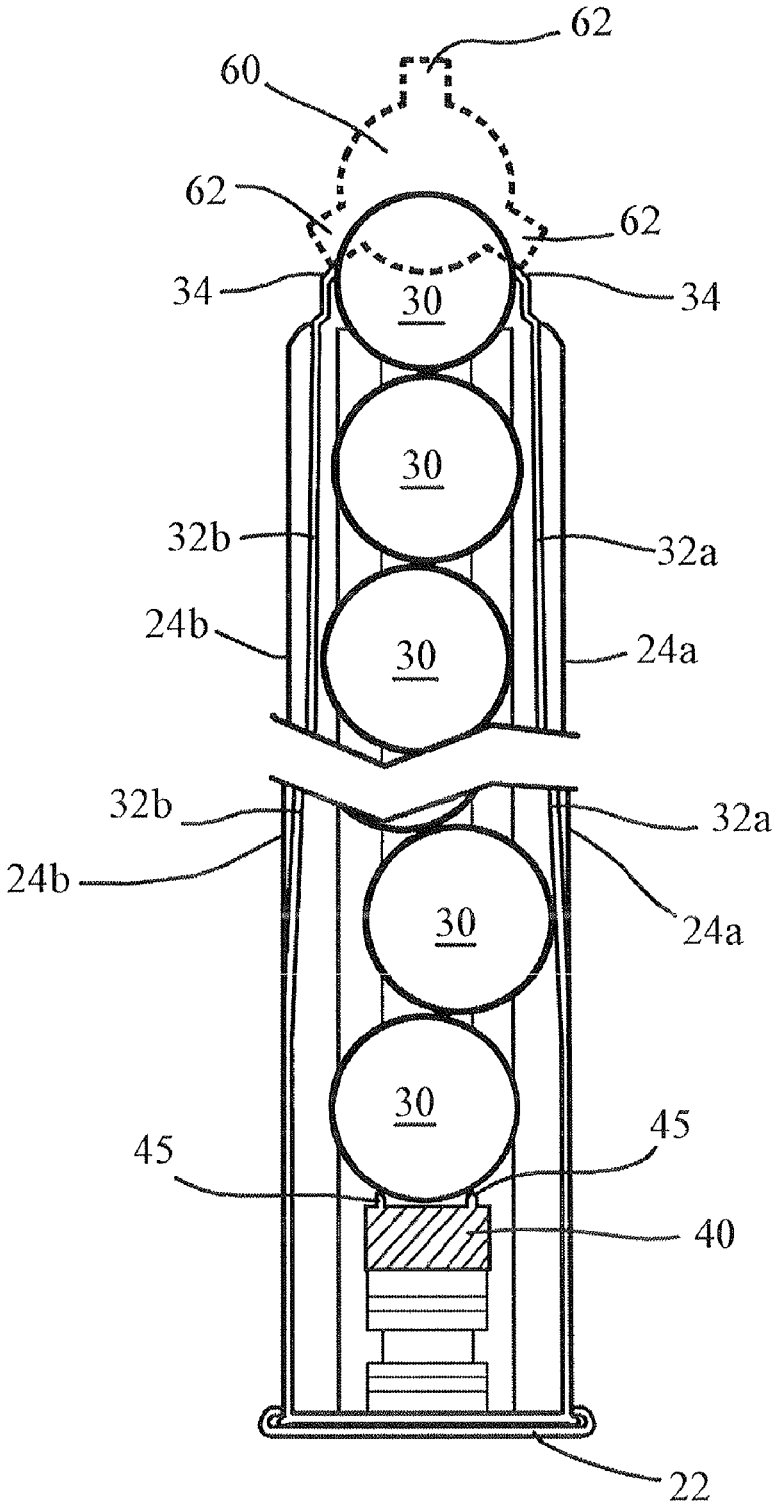
FIG. 6 is an end cross-sectional elevational view of the magazine of FIGS. 1-5, along lines 6-6 of FIG. 2, showing the stacking of the cartridges and the engagement of the top cartridge in the feed lips by the bolt of the firearm.
Figure 7:
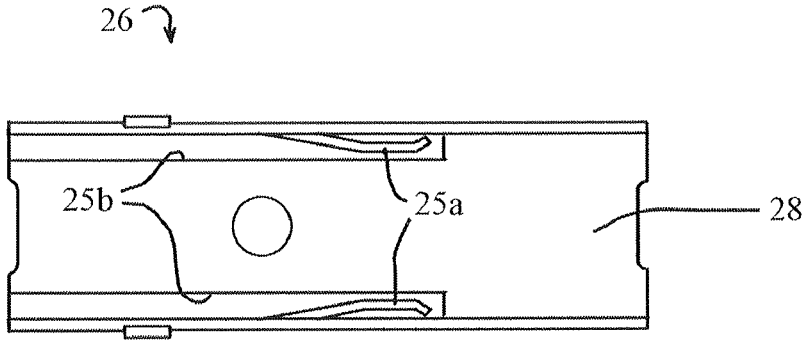
FIG. 7 is a cross-sectional view of the guide insert within the reinforcing member of FIG. 3.

Feed lips 34 may be formed integrally from the upper portions of side wall tapering portions 32*a*, 32*b* and extend inward toward each other in an arc. The feed lips may have substantially parallel upper edges 34*a*, 34*b* and may have a spacing of somewhat less than the cartridge diameter, e.g., 0.010 in (0.25 mm) less, for maintaining contact with at least the mid-portion of the length of each cartridge 30 as it is loaded into the firearm breech. The thickness of the feed lips should be selected to permit slight flexing against the force of the cartridge. Since side wall portions 32*a*, 32*b* taper inwardly in the x-direction toward the nose of the cartridge, feed lips 34 are formed so that the ends nearer the rear housing wall 32*c* extend inwardly a distance $y_1$ from the upper end of side wall portions 32*a*, 32*b* to a greater degree than the inwardly extending distance $y_2$ of the feed lip ends nearer the front housing wall 32*d*. The length of the feed lips 34 in the x-direction corresponds to the length of the release point of the action of the firearm. As shown in FIG. 6, feed lips 34 present the top-most cartridge 30 at a sufficient height to permit clearance of the 120° spaced lugs 62 of the firearm bolt 60 that pushes the cartridge into the firearm breech.

To provide increased strength to the magazine housing, reinforcing member 26 (which also may be formed from sheet metal) is sized to fit snugly within the front portion of housing 24. Reinforcing member 24 has sides corresponding to the front wall 32*d* and a portion of the length of side walls 24*a*, 24*b* to prevent bowing of the housing walls. To properly position the reinforcing member in the z-direction within the housing, one or more corresponding detents are formed between the walls of the housing 24 and the walls of the reinforcing member, for example, recess opening 23*a* in side wall 24*a* and protrusion 23*b* in reinforcing member 26 (or vice-versa). Reinforcing member 26 may be spot welded or otherwise secured within housing 24 after positioning.

A guide insert 28 is sized to slide into reinforcing member 26. Guide insert 28 may be made from a heat resistant molded polymeric material and provides protection to the noses of the cartridges. Guide insert 28 is removable and has a slot or channel extending along the side facing the rear of the housing to receive the cartridge noses. So that more than one cartridge length may be accommodated, guide insert 28 may be made of different lengths in the x-direction. For example, a guide insert for a longer cartridge will have a shorter x-length than a guide insert for a shorter cartridge.

Figure 10:
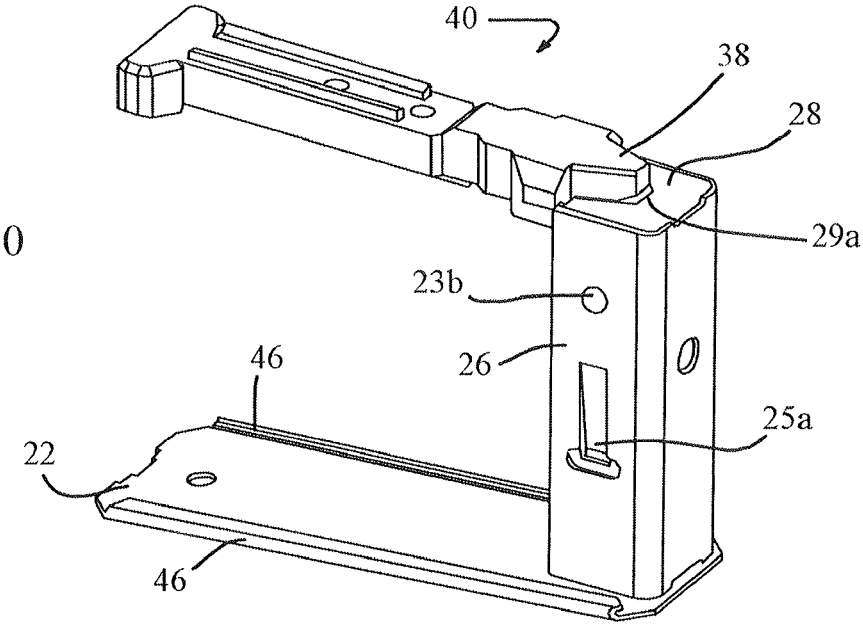
FIG. 10 is a perspective view of another embodiment of the cartridge follower with the reinforcing member, guide insert and floor plate.
Figure 11:
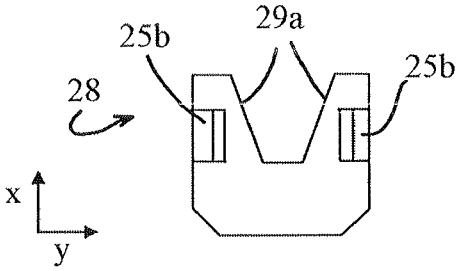
FIG. 11 is a top plan view of the guide insert of FIG. 9.
Figure 12:
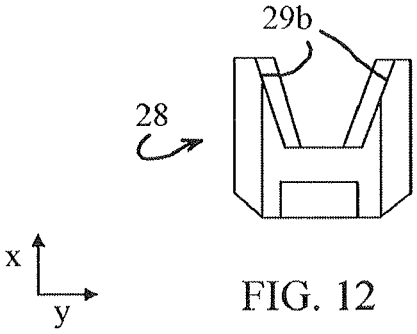
FIG. 12 is a bottom view of the guide insert of FIG. 9.
Figure 13:
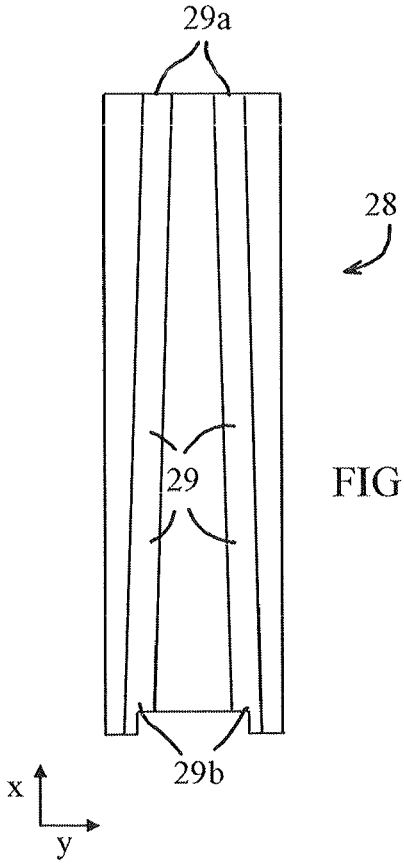
FIG. 13 is a rear elevational view of the guide insert of FIG. 9.
Figure 14:
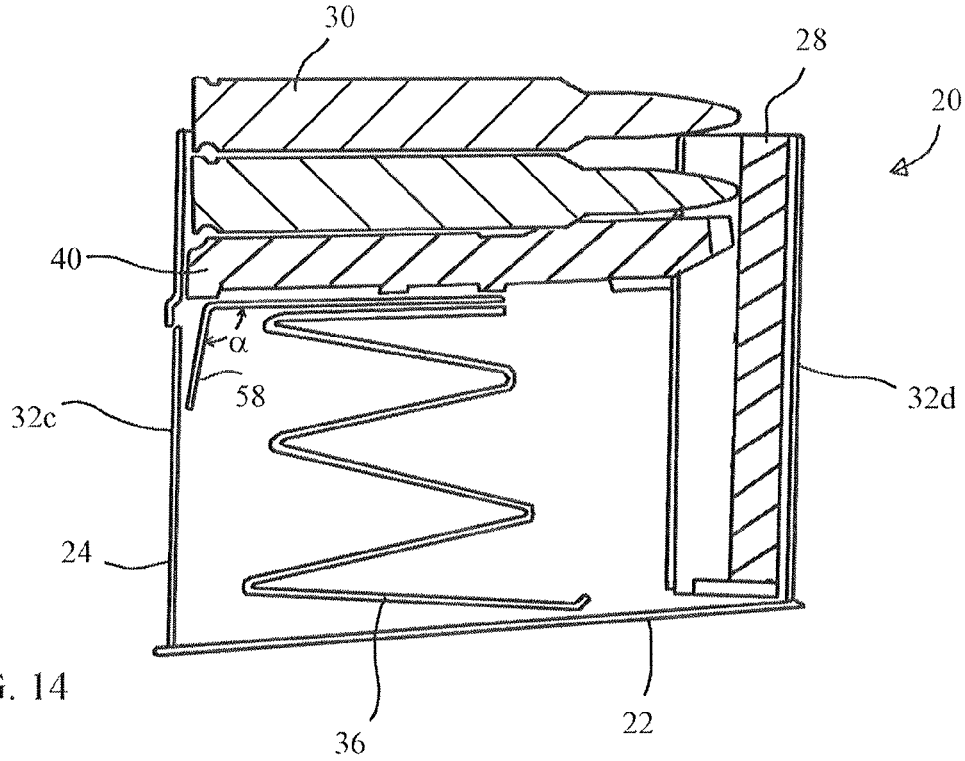
FIG. 14 is an enlargement of the lower portion of FIG. 2, showing a secondary spring to hold level the cartridge follower.

As shown in FIGS. 10-12, the guide insert slot 29 may be a truncated V shape having a greater width in the y-direction between the slot walls at the lower end 29*b* than at the upper end 29*a*, so that the slot tapers inwardly toward the upper end. Regardless of cartridge used, the slot should be sized to permit the cartridge noses to slide freely as the cartridges are fed upward and out of the housing. Guide insert is fixed in position in the housing by projections or spring tabs 25*a* formed in the side walls of reinforcing member 26 and extending inwardly into corresponding molded slots 25*b* along a portion of the guide insert outer side walls (FIG. 6). The z-direction length of slots 25*b* corresponds to the z-direction positioning of spring tab 25*a*. Alternatively, a frictional fit may be employed to retain the guide insert within the reinforcing member.

Figure 4:
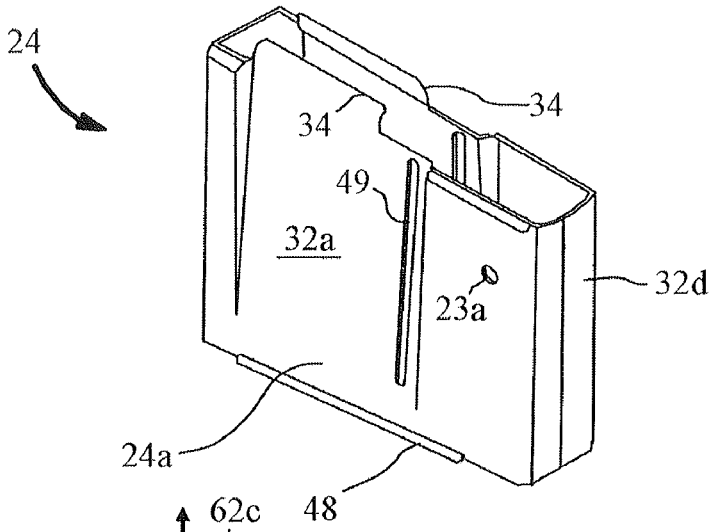
FIG. 4 is a perspective view of the magazine housing of FIG. 1 showing the insertion of the optional insert for smaller caliber cartridges.
Figure 5:
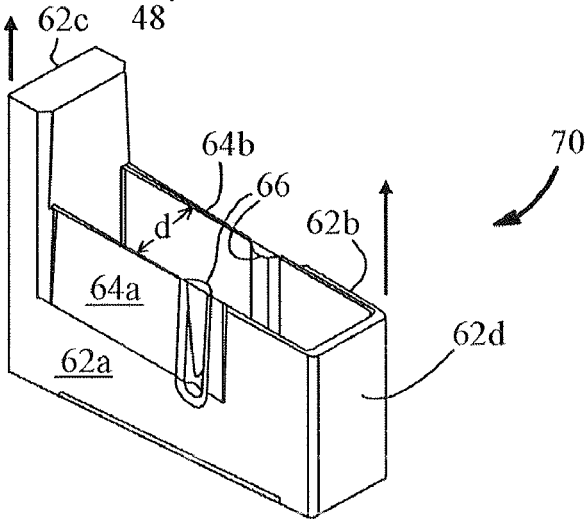
FIG. 5 is a close up of the feed lips on the magazine housing of FIG. 4.
Figure 5:
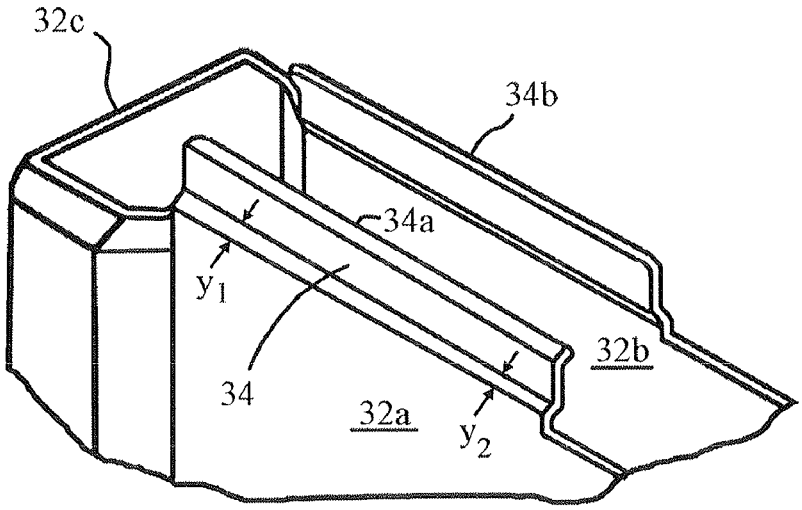
Figure 15:
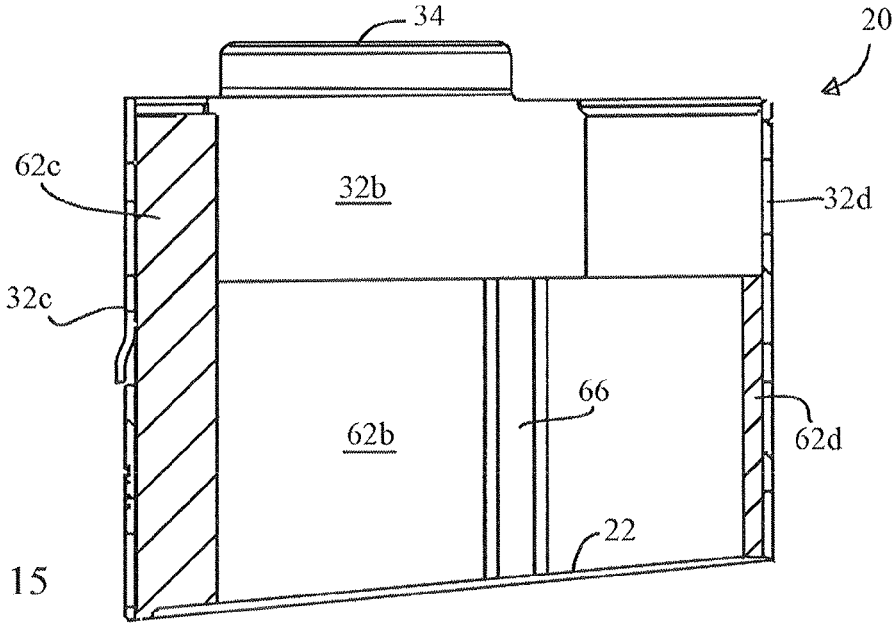
FIG. 15 is a cross sectional elevational view of the insert of FIG. 4 installed in the magazine housing.

Additionally, one or more optional removable inserts may be fitted within the housing along the interiors of side walls 24*a*, 24*b* to reduce the interior width, and permit the magazine to accommodate cartridges of smaller caliber or diameter. One such insert 70 is shown in FIGS. 4 and 15, and may be made of a heat resistant molded polymer or other suitable material. Insert 70 has opposing side walls 62*a*, 62*b* and rear wall 62*c* and front wall 62*d* joining the side walls. The external size of the walls may be sufficient to create a snug, sliding fit as the insert is moved upward through the lower opening of cartridge housing 24, as shown in FIG. 4. The thickness of the side walls 62*a*, 62*b* is selected to provide a desired internal width d to accommodate smaller diameter cartridges in a stacked formation. The upper portions 64*a*, 64*b* of side walls 62*a*, 62*b*, respectively, may be tapered to end in a reduced side wall thickness at their upper ends. The thickness of rear wall 62*c* is selected to accommodate the length of the smaller diameter cartridges. The height of the side walls 62*a*, 62*b* and front wall 62*d* may be less than the height of the magazine housing as shown, or may be any other desired height. Ribs 66 may be formed inwardly and extend vertically along the insert side walls to correspond to ribs 49 of the cartridge housing and the angle of the cartridge shoulder, again to help position the cartridges as they are fed upward. Insert 70 may be configured for use with guide insert 28, by having no front wall, and the lower end is open to receive the cartridge follower, described below.

Figure 9:
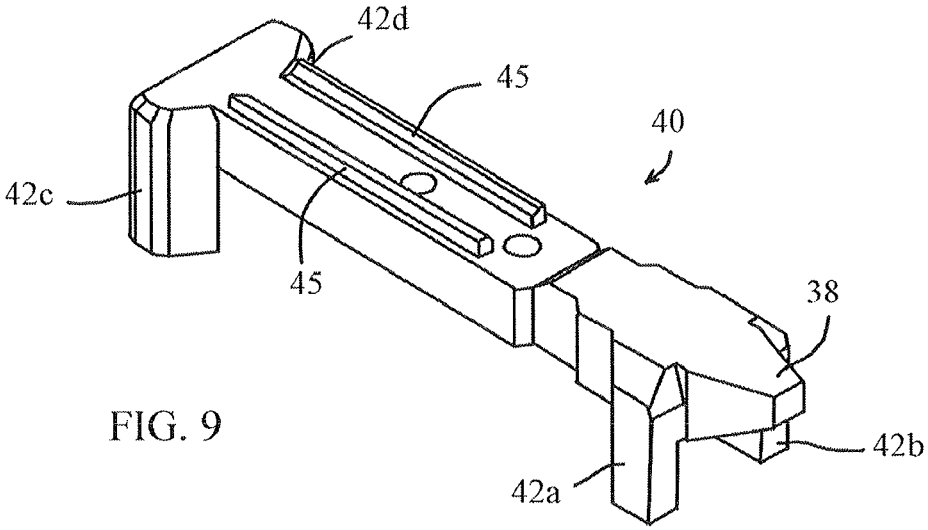
FIG. 9 is a perspective view of one embodiment of the cartridge follower that may be used with the magazine of FIG. 1.

Floor plate 22 has folded-over inward facing slots 46 on either side to slide onto tabs 48 extending outward from the lower edges of the housing side walls. Disposed over the floor plate and between the side walls is follower 40, which contacts the lowermost cartridge in the stack and pushes it and the stack upward toward the feed lips. Floor plate 22 supports a follower spring 36 which urges movable cartridge follower 40 upward. Cartridge follower 40 may be made of a heat resistant molded polymer or other suitable material. Spring 36 and floor plate 22 may have corresponding projections/recesses to locate an end of the spring at a desired location with respect to the housing floor. Follower 40 may have a cross section approximately that of a cartridge and include at the end adjacent the front wall 32*d* of the housing a projecting V shaped nose portion 38 that is configured to fit into and slide vertically along guide insert slot 29 (FIG. 9). A pair of longitudinal projections 45 on the top surface of follower 40 extend along at least a portion of the lowermost or last cartridge in the housing to center the cartridge between the opposing side walls as the cartridges are urged upwards.

Figure 8:
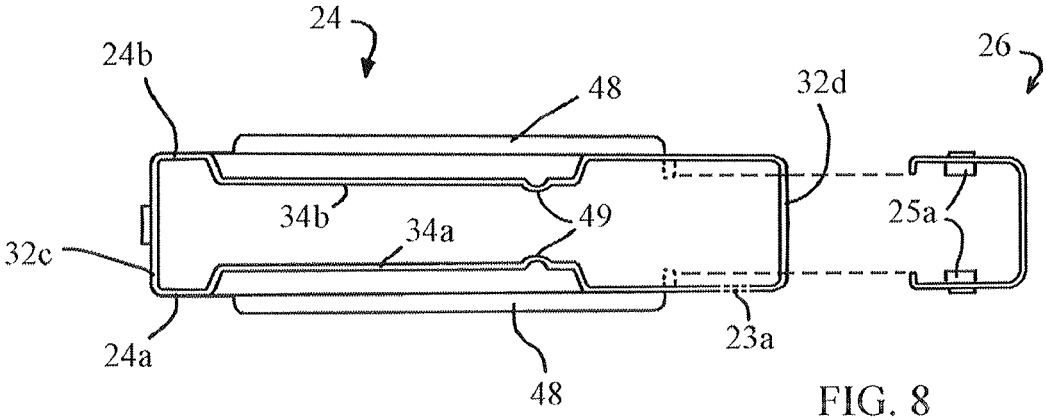
FIG. 8 is a top plan view of the reinforcing member and magazine housing of FIG. 3.

Side-to-side tilting of the follower is prevented by optional vertically (z-direction) downwardly extending follower members or legs 42*a*, 42*b*, 42*c*, 42*d* disposed at the four corners of follower 40 (FIG. 8). The outer surfaces of legs 42*a*, 42*b*, 42*c*, 42*d* slide against the inner surfaces of the housing walls as the follower is urged upwards to feed the cartridges out of the magazine housing. Back legs 42*c*, 42*d* slide along the corner formed by side walls 24*a*, 24*b* and rear wall 32*c*. Front legs 42*a*, 42*b* slide along the corner formed by side walls 24*a*, 24*b* and inward rear edges of reinforcing member 24. The legs maintain position of follower 40 with respect to the side walls and restrict tilting of the follower, preferably so it does not tilt beyond 10° from horizontal.

Member 58 (FIGS. 2 and 14), which may be made of spring steel or other material, extends downward from follower 40 near the end adjacent rear wall 32*c* at an angle α from horizontal. Member 58 has in one aspect a leveling function to prevent the end of follower 40 adjacent front wall 32*d* from diving downward at an angle as the cartridges are loaded. To prevent such diving, member 58 would contact rear wall 32*c* and restrict further rotation of the follower. Member 58 has in another aspect a capacity limiting function to prevent additional cartridges from being loaded into the magazine beyond the maximum rating. If for example, the magazine were rated for a maximum of 10 cartridges but was sized to be physically capable of holding more, the length of member 58 would be configured so that the lower end contacts floor plate 22, and prevents follower 40 from further lowering, when 10 cartridges were received. For these functions, angle α of member 58 is preferably in excess of about 90°, more preferably about 105°. Member 58 maintains position of follower 40 with respect to floor 22 or rear wall 32*c*, as desired, to prevent jamming of the cartridges as they are fed into the firearm.

To load the magazine, floor plate 22 and follower 40 are removed and cartridges 30 are fed into to lower opening and generally vertically stacked within the housing until it is filled to feed lips 34. The additional width at the bottom of the magazine housing permits the cartridges to be somewhat staggered from side-to-side, but the inward taper forces the cartridges into a generally straight single column as they reach the top. Follower 40 with spring 36 and floor plate 22 are then replaced onto the magazine. After the magazine is clipped to the rifle or other gun, the spring-loaded follower 40 urges the cartridges upward and the feed lips 34 hold and present the topmost cartridge as the bolt feeds the cartridge into the gun breech. In the event that different size cartridges are to be used, the appropriate length guide insert 28 and/or different width side inserts are placed in the magazine housing.

The present invention therefore provides an improved firearm cartridge magazine that has one or more of the following advantages: effective guiding to the cartridges; protection to the noses of the cartridges from dents or flattening of the apex to reduce erratic bullet flight and increase accuracy; increased magazine strength; increased efficiency in feeding of cartridges into breech; better centerline presentation of the cartridge case to the firearm chamber to enhances the final positioning of the cartridge case shoulder in concentricity to the chamber; and modular configuration to permit cartridges of different sizes to be employed.

While the present invention has been particularly described, in conjunction with specific embodiments, it is evident that many alternatives, modifications and variations will be apparent to those skilled in the art in light of the foregoing description. it is therefore contemplated that the appended claims will embrace any such alternatives, modifications and variations as falling within the true scope and spirit of the present invention.

Thus, having described the invention, what is claimed is:

1. A firearms magazine comprising:

a housing having feed lips for simultaneously contacting cartridges during feeding of the cartridges into a firearm;

opposite side walls below the feed lips defining an interior length sufficient to retain a plurality of firearms cartridges; and a removable insert between the opposite side walls having a slot along its height, the slot having a truncated V-shape extending along sides of noses of the firearms cartridges to receive the noses of the cartridges and permit the firearms cartridges to slide freely and feed out of the magazine;

wherein the slot of the removable insert has a greater width between slot walls at a lower end than at an upper end and is tapered in cross-section inwardly toward the upper end.

2. The firearms magazine of claim 1 wherein the removable insert is polymeric.

3. The firearms magazine of claim 1 wherein the housing has an upper end and a lower end; and wherein the truncated V-shape slot has slot walls and the slot has a greater width between the slot walls at the housing lower end than at the housing upper end, is tapered in cross-section inwardly toward the upper end.

4. The firearms magazine of claim 3 wherein the cartridges have a cartridge base, a cartridge nose, and a cartridge shoulder between the base and nose, and wherein, adjacent the removable insert, each of the housing side walls has a rib extending vertically inwardly corresponding to the cartridge shoulder.

5. The firearms magazine of claim 3 further including a reinforcing member extending between and along an end of the opposite side walls corresponding to noses of the firearms cartridges, the removable insert being disposed within the reinforcing member to receive the noses of the firearms cartridges.

6. The firearms magazine of claim 3 wherein the opposite side walls below the feed lips define an interior length sufficient to retain a plurality of firearms cartridges of a first length, and the removable insert reduces the interior length to retain a plurality of firearms cartridges of a second length less than the first length.

* * * * *